United States Patent [19]

Yodogawa et al.

[11] 4,077,915

[45] Mar. 7, 1978

[54] NON-LINEAR RESISTOR

[75] Inventors: Masatada Yodogawa; Susumu Miyabayashi; Yoshinari Yamashita; Takashi Yamamoto; Kohji Hayashi; Hisayoshi Ueoka, all of Tokyo, Japan

[73] Assignee: TDK Electronics Co., Ltd., Tokyo, Japan

[21] Appl. No.: 719,969

[22] Filed: Sep. 2, 1976

[30] Foreign Application Priority Data

| | | |
|---|---|---|
| Sep. 18, 1975 | Japan | 50-112943 |
| Oct. 3, 1975 | Japan | 50-119432 |
| Oct. 3, 1975 | Japan | 50-119434 |
| Oct. 3, 1975 | Japan | 50-119435 |
| Apr. 6, 1976 | Japan | 51-38502 |

[51] Int. Cl.$^2$ ..... H01B 1/08

[52] U.S. Cl. ..... 252/521; 338/21; 106/73.2

[58] Field of Search ..... 252/521; 338/21; 106/73.2

[56] References Cited

U.S. PATENT DOCUMENTS

| | | | |
|---|---|---|---|
| 3,598,763 | 8/1971 | Matsuoka et al. | 252/521 |
| 4,033,906 | 7/1977 | Nagasawa et al. | 252/521 X |
| 4,038,217 | 7/1977 | Namba et al. | 252/521 |

FOREIGN PATENT DOCUMENTS

| | | |
|---|---|---|
| 74-86,894 | 8/1974 | Japan. |
| 74-108,595 | 10/1974 | Japan. |

*Primary Examiner*—Richard E. Schafer
*Assistant Examiner*—E. Suzanne Parr
*Attorney, Agent, or Firm*—Oblon, Fisher, Spivak, McClelland & Maier

[57] ABSTRACT

A non-linear resistor comprises a sintered body of a ceramic composition which comprises 99.94 to 80.0 mole % of zinc oxide as ZnO, 0.02 to 10.0 mole % of the specific rare earth oxide selected from the group consisting of oxides of cerium, praseodymium, neodymium, samarium, europium, gadolinium, terbium, dysprosium, holmium, erbium, thulium, ytterbium, and lutetium as $R_2O_3$, and 0.04 to 10 mole % of manganese oxide as MnO.

3 Claims, No Drawings

NON-LINEAR RESISTOR

BACKGROUND OF THE INVENTION

The present invention relates to a non-linear resistor comprising a sintered body of a ceramic composition which comprises zinc oxide, a specific rare earth oxide and manganese oxide which has high n-value of non-linearity based on the sintered body itself.

The conventional non-linear resistors (hereinafter referring to as varistor) include silicon carbide varistors and silicon p-n junction diodes. Recently, varistors comprising a main component of zinc oxide and an additive have been proposed.

The voltage-ampere characteristic of a varistor is usually shown by the equation $$I = \left(\frac{V}{C}\right)^n$$

wherein V designates a voltage applied to the varistor and I designates a current passed through the varistor and C designates a constant corresponding to the voltage when the current is passed. The exponent $n$ can be given by the equation $$n = \frac{\log_{10}\left(\frac{I_2}{I_1}\right)}{\log_{10}\left(\frac{V_2}{V_1}\right)}$$

wherein $V_1$ and $V_2$ respectively designate voltages under passing the current $I_1$ or $I_2$.

A resistor having $n = 1$ is an ohmic resistor and the non-linearity is superior when the n-value is higher. It is usual that n-value is desirable as high as possible.

The optimum C-value is dependent upon the uses of the varistor and it is preferable to obtain a sintered body of a ceramic composition which can easily give a wide range of the C-value.

The silicon carbide varistors can be obtained by sintering silicon carbide powder with a ceramic binding material.

The non-linearity of the silicon carbide varistor is based on voltage dependency of contact resistance between silicon carbide grains. Accordingly, the C-value of the varistor can be controlled by varying a thickness in the direction of the current passed through the varistor. However, the non-linear exponent $n$ is relatively low as 3 to 7.

Moreover, it is necessary to sinter it in a non-oxidizing atmosphere. On the other hand, the non-linearity of the silicon p-n junction diode is caused by the p-n junction of silicon whereby it is impossible to control the C-value in a wide range.

Varistors comprising a sintered body of ceramic composition comprising a main component of zinc oxide and the other additive of Bi, Sb, Mn, Co or Cr, have been developed.

The non-linearity of said varistors is based on the sintered body itself and is remarkably high advantageously.

On the other hand, a volatile component which is vaporizable at high temperature required for sintering the mixture for the varistor, such as bismuth is included whereby it is hard to sinter the mixture to form varistors having the same characteristics in mass production without substantial loss.

SUMMARY OF THE INVENTION

It is an object of the present invention to provide a non-linear resistor comprising a sintered body of ceramic composition which has no disadvantage stated above.

It is another object of the invention to provide a non-linear resistor comprising a sintered body of ceramic composition which has non-linearity depending upon the sintered body itself whereby the C-value of the varistor can be easily controlled by varying the n-value given by varying the thickness of the sintered body in the direction of the current passed, without varying the n-value.

It is another object of the invention to provide a non-linear resistor through which a large current which is hardly passed through a Zenner diode, can be passed.

It is the other object of the invention to provide a non-linear resistor comprising a sintered body of ceramic composition which does not contain a volatile component which is vaporizable in the sintering step whereby it is easily sintered in air without substantial loss.

The object of the invention can be attained by providing a non-linear resistor comprising a sintered body of ceramic composition which comprises 99.94 to 80.0 mole % of zinc oxide as ZnO, 0.02 to 10.0 mole % of a rare earth oxide selected from the group consisting oxides of cerium, praseodymium, neodymium, samarium, europium, gadolinium, terbium, dysprosium, holmium, erbium, thulium, ytterbium and lutetium as $R_2O_3$, and 0.04 to 10 mole % of manganese oxide as MnO.

DETAILED DESCRIPTION OF THE PREFERRED EMBODIMENTS

It is especially preferable to use the sintered body of a ceramic composition which comprises 99.85 to 92.0 mole % of zinc oxide as ZnO, 0.05 to 4.0 mole % of the specific rare earth oxide as $R_2O_3$ and 0.1 to 4.0 mole % of manganese oxide as MnO. Yet another preferred embodiment of the ceramic composition of the invention is composed of 99.6 to 93.0 mole % of zinc oxide as ZnO, 0.1 to 4.0 mole % of a specific rare earth oxide designated as $R_2O_3$ and 0.3 to 3.0 mole % of manganese oxide as MnO.

The ceramic composition for the varistor (non-linear resistor) can be prepared by the conventional processes.

In typical process for preparing the sintered body of ceramic composition, the weighed raw components were uniformly mixed by a wet ball-mill and the mixture was dried and calcined. The temperature for the calcination is preferably in a range of 700° C to 1200° C.

The calcination of the mixture is not always necessary, but it is preferable to carry out the calcination so as to decrease fluctuation of characteristics of the varistor.

The calcined mixture is pulverized by a wet ball-mill and is dried and mixed with a binder to form a desirable shape.

In the case of a press molding, the pressure for molding is enough to be 100 to 2,000 Kg/cm$^2$.

The optimum temperature for sintering the shaped composition is dependent upon the composition and is preferably in a range of 1,000° to 1,450° C. The atmosphere for the sintering operation can be air, and can be also a non-oxidizing atmosphere such as nitrogen and argon to obtain high n-value of the varistor.

An electrode can be ohmic contact or non-ohmic contact with the sintered body and can be made of silver, copper, aluminum, zinc, indium, nickel or tin. The characteristics are not substantially affected by the kind of metal. The electrode can be prepared by a metallizing, a vacuum metallizing, an electrolytic plating, an electroless plating, or spraying method etc.. The raw materials for the ceramic composition of the invention can be various forms such as oxides, carbonates, oxalates, nitrates which can be converted to oxides in the sintering step.

The characteristics of the varistor are not substantially affected by the form of the raw materials. It is preferable to use the raw materials so as to give fine uniform structure.

The manganese can be incorporated by diffusing it after sintering a shaped body.

It is possible to incorporate the other impurities or additives in the ceramic composition as far as the characteristics of the varistor are not adversely affected.

The invention will be further illustrated by certain examples.

EXAMPLE

The oxides of raw materials were weighed at the ratio listed in Table 1 and were mixed in a wet ball-mill for 20 hours.

The mixture was dried and polyvinyl alcohol was added as a binder and the mixture was granulated and was shaped to a disc having a diameter of 11 mm, a thickness of 1.2 mm by a press molding method.

The shaped body was sintered at 1,000° C to 1450° C.

Each electrode was connected to both sides of the sintered body and the voltage-ampere characteristics of them were measured. The results are shown in Table 1 wherein the C-values are shown by a unit V/mm under passing the current of 1 mA/cm$^2$. (V/mm: voltage/-thickness).

Table 1

| Sample | Composition (mole %) ZnO | MnO | R | $R_2O_3$ | n-value | C-value |
|---|---|---|---|---|---|---|
| Example 1 | 99.86 | 0.04 | Dy | 0.1 | 10.5 | 49 |
| 2 | 98.96 | 0.04 | Dy | 1 | 17.0 | 140 |
| 3 | 95.96 | 0.04 | Dy | 4 | 11.0 | 312 |
| 4 | 99.8 | 0.1 | Dy | 0.1 | 18.1 | 95 |
| 5 | 98.9 | 0.1 | Dy | 1 | 36.3 | 295 |
| 6 | 95.9 | 0.1 | Dy | 4 | 30.2 | 440 |
| 7 | 98.98 | 1 | Dy | 0.02 | 20.0 | 172 |
| 8 | 98.95 | 1 | Dy | 0.05 | 39.4 | 312 |
| 9 | 98.9 | 1 | Dy | 0.1 | 49.1 | 415 |
| 10 | 98 | 1 | Dy | 1 | 52.0 | 525 |
| 11 | 95 | 1 | Dy | 4 | 38.2 | 470 |
| 12 | 89 | 1 | Dy | 10 | 19.1 | 378 |
| 13 | 95.98 | 4 | Dy | 0.02 | 5.5 | 85 |
| 14 | 95.95 | 4 | Dy | 0.05 | 11.5 | 213 |
| 15 | 95.9 | 4 | Dy | 0.1 | 20.2 | 300 |
| 16 | 95 | 4 | Dy | 1 | 37.1 | 442 |
| 17 | 92 | 4 | Dy | 4 | 37.5 | 445 |
| 18 | 86 | 4 | Dy | 10 | 20.3 | 370 |
| 19 | 89.98 | 10 | Dy | 0.02 | 5.4 | 39 |
| 20 | 89.95 | 10 | Dy | 0.05 | 9.1 | 51 |
| 21 | 89.9 | 10 | Dy | 0.1 | 12.3 | 65 |
| 22 | 89 | 10 | Dy | 1 | 15.4 | 170 |
| 23 | 86 | 10 | Dy | 4 | 18.5 | 285 |
| 24 | 80 | 10 | Dy | 10 | 15.5 | 300 |
| 25 | 99.86 | 0.04 | Sm | 0.1 | 10.9 | 72 |
| 26 | 98.96 | 0.04 | Sm | 1 | 16.5 | 172 |
| 27 | 95.96 | 0.04 | Sm | 4 | 12.1 | 280 |
| 28 | 99.8 | 0.1 | Sm | 0.1 | 14.0 | 232 |
| 29 | 98.9 | 0.1 | Sm | 1 | 36.7 | 412 |
| 30 | 95.9 | 0.1 | Sm | 4 | 35.0 | 400 |
| 31 | 98.98 | 1 | Sm | 0.02 | 20.4 | 262 |
| 32 | 98.95 | 1 | Sm | 0.05 | 34.7 | 391 |
| 33 | 98.9 | 1 | Sm | 0.1 | 39.7 | 422 |
| 34 | 98 | 1 | Sm | 1 | 42.3 | 458 |

Table 1-continued

| Sample | Composition (mole %) ZnO | MnO | R | $R_2O_3$ | n-value | C-value |
|---|---|---|---|---|---|---|
| 35 | 95 | 1 | Sm | 4 | 37.2 | 412 |
| 36 | 89 | 1 | Sm | 10 | 25.3 | 355 |
| 37 | 95.98 | 4 | Sm | 0.02 | 12.8 | 149 |
| 38 | 95.95 | 4 | Sm | 0.05 | 20.9 | 279 |
| 39 | 95.9 | 4 | Sm | 0.1 | 27.0 | 362 |
| 40 | 95 | 4 | Sm | 1 | 35.2 | 410 |
| 41 | 92 | 4 | Sm | 4 | 35.5 | 405 |
| 42 | 86 | 4 | Sm | 10 | 25.2 | 356 |
| 43 | 89.98 | 10 | Sm | 0.02 | 5.2 | 48 |
| 44 | 89.95 | 10 | Sm | 0.05 | 6.6 | 70 |
| 45 | 89.9 | 10 | Sm | 0.1 | 8.0 | 91 |
| 46 | 89 | 10 | Sm | 1 | 16.7 | 238 |
| 47 | 86 | 10 | Sm | 4 | 22.6 | 301 |
| 48 | 80 | 10 | Sm | 10 | 19.0 | 282 |
| 49 | 98.95 | 1 | Nd | 0.05 | 33.9 | 496 |
| 50 | 98 | 1 | Nd | 1 | 39.4 | 565 |
| 51 | 95 | 1 | Nd | 4 | 34.2 | 522 |
| 52 | 98.9 | 0.1 | Nd | 1 | 33.7 | 483 |
| 53 | 95 | 4 | Nd | 1 | 35.2 | 522 |
| 54 | 98.95 | 1 | Gd | 0.05 | 36.7 | 532 |
| 55 | 98 | 1 | Gd | 1 | 40.0 | 602 |
| 56 | 95 | 1 | Gd | 4 | 35.0 | 581 |
| 57 | 98.9 | 0.1 | Gd | 1 | 32.9 | 448 |
| 58 | 95 | 4 | Gd | 1 | 36.3 | 579 |
| 59 | 98.95 | 1 | Eu | 0.05 | 38.2 | 507 |
| 60 | 98 | 1 | Eu | 1 | 45.0 | 556 |
| 61 | 95 | 1 | Eu | 4 | 38.1 | 518 |
| 62 | 98.9 | 0.1 | Eu | 1 | 36.6 | 493 |
| 63 | 95 | 4 | Eu | 1 | 38.4 | 517 |
| 64 | 98.95 | 1 | Ho | 0.05 | 26.2 | 413 |
| 65 | 98 | 1 | Ho | 1 | 32.0 | 487 |
| 66 | 95 | 1 | Ho | 4 | 28.3 | 451 |
| 67 | 98.9 | 0.1 | Ho | 1 | 28.7 | 435 |
| 68 | 95 | 4 | Ho | 1 | 28.8 | 460 |
| 69 | 98.95 | 1 | Er | 0.05 | 27.2 | 581 |
| 70 | 98 | 1 | Er | 1 | 37.0 | 576 |
| 71 | 95 | 1 | Er | 4 | 35.2 | 570 |
| 72 | 98.9 | 0.1 | Er | 1 | 32.8 | 541 |
| 73 | 95 | 4 | Er | 1 | 34.6 | 552 |
| 74 | 98 | 1 | Ce | 1 | 27.4 | 551 |
| 75 | 98 | 1 | Pr | 1 | 25.8 | 316 |
| 76 | 98 | 1 | Tb | 1 | 28.3 | 460 |
| 77 | 98 | 1 | Tm | 1 | 31.0 | 574 |
| 78 | 98 | 1 | Yb | 1 | 36.0 | 469 |
| 79 | 98 | 1 | Lu | 1 | 33.4 | 605 |
| 80 | 98.8 | 1 | Ce<br>Pr | 0.1<br>0.1 | 24.6 | 523 |
| 81 | 98.8 | 1 | Nd<br>Sm | 0.1<br>0.1 | 40.4 | 556 |
| 82 | 98.8 | 1 | Eu<br>Gd | 0.1<br>0.1 | 43.5 | 584 |
| 83 | 98.8 | 1 | Tb<br>Dy | 0.1<br>0.1 | 50.6 | 478 |
| 84 | 98.8 | 1 | Ho<br>Er | 0.1<br>0.1 | 34.5 | 549 |
| 85 | 98.7 | 1 | Ce<br>Pr<br>Nd | 0.1<br>0.1<br>0.1 | 39.3 | 566 |
| 86 | 98.7 | 1 | Sm<br>Eu<br>Gd | 0.1<br>0.1<br>0.1 | 44.3 | 590 |
| 87 | 98.7 | 1 | Tb<br>Dy<br>Ho | 0.1<br>0.1<br>0.1 | 51.4 | 504 |
| Reference 1 | 99.96 | 0.04 | | 0 | 1.9 | 15 |
| 2 | 99.9 | 0.1 | | 0 | 2.0 | 48 |
| 3 | 99 | 1 | | 0 | 3.5 | 55 |
| 4 | 96 | 4 | | 0 | 4.0 | 50 |
| 5 | 90 | 10 | | 0 | 4.2 | 35 |

As shown in Table 1, the ceramic compositions having 0.02 to 10.0 mole % of $R_2O_3$ and 0.04 to 10.0 mole % of MnO imparted remarkably high n-value depending upon the type of the specific rare earth.

Some of the ceramic composition imparted the n-value of 52. The remarkable characteristics can be attained by comprising zinc oxide, the specific rare earth oxide and manganese oxide.

The excellent n-value can be given by the ceramic composition comprising 99.94 to 80.0 mole % of zinc oxide as ZnO, 0.02 to 10.0 mole % of the specific rare earth oxide as $R_2O_3$ and 0.04 to 10.0 mole % of manganese oxide as MnO.

When $R_2O_3$ content is less than 0.02 mole % or MnO content is less than 0.04 mole %, the n-value of the ceramic composition is too low.

When $R_2O_3$ content is higher than 10 mole % or MnO content is higher than 10 mole %, the n-value of the ceramic composition is too low.

As stated above, the varistors comprising a sintered body of the ceramic composition of the invention had excellent non-linearity and can be used for the purpose of circuit voltage stabilization, instead of a constant voltage Zenner diode as well as for the purpose of a surge absorption and suppression of abnormal voltage.

It is hard to pass a large current through the Zenner diode. However, it is possible to pass a large current through the varistor of the invention by increasing the electrode area i.e., the area of the varistor. In principle, the C-value for a varistor whose non-linearity is based on the sintered body itself can be increased by increasing the thickness of the varistor in the direction passing a current.

On the other hand, when the C-value of the sintered body is higher, the thickness thereof can be thinner to decrease the size of the sintered body for passing a desirable current.

The varistor of the invention can have a wide range of the C-value by selecting the components in the composition and sintering conditions. The non-linearity of the varistor is especially remarkable in a range of the C-value of 250 to 600 volts.

The varistor of the invention is superior to the conventional zinc oxide type varistor containing bismuth which has the C-value of 100 to 300 volts. Accordingly, the varistor of the invention can be expected to impart special characteristics as a high voltage varistor for a color TV and an electronic oven, etc..

The components of the composition of the invention are zinc oxide, the specific rare earth oxide and manganese oxide and do not include a volatile component which is vaporizable in the sintering operation, such as bismuth. Accordingly, the process for preparing the ceramic compositions is easy and the fluctuation of the characteristics of the varistors is small to be excellent reproducibility.

It is easy to prepare them in mass production without substantial loss, to be low cost. Accordingly, there are significant advantages in practice.

What is claimed is:

1. A non-linear resistor comprising a sintered body of a ceramic composition which consists essentially of 99.94 to 80.0 mole % of zinc oxide as ZnO, 0.02 to 10.0 mole % of the specific rare earth oxide selected from the group consisting of oxides of cerium, praseodymium, neodymium, samarium, europium, gadolinium, terbium, dysprosium, holmium, erbium, thulium, ytterbium, and lutetium as $R_2O_3$ and 0.04 to 10 mole % of manganese oxide as MnO.

2. A non-linear resistor comprising a sintered body of a ceramic composition which consists essentially of 99.85 to 92.0 mole % of zinc oxide as ZnO, 0.05 to 4.0 mole % of the specific rare earth oxide selected from the group consisting of oxides of cerium, praseodymium, neodymium, samarium, europium, gadolinium, terbium, dysprosium, holmium, erbium, thulium, ytterbium and lutetium as $R_2O_3$ and 0.1 to 4 mole % of manganese oxide as MnO.

3. A non-linear resistor comprising a sintered body of a ceramic composition which consists essentially of 99.6 to 93.0 mole % of zinc oxide as ZnO, 0.1 to 4.0 mole % of the specific rare earth oxide selected from the group consisting of oxides of cerium, praseodymium, neodymium, samarium, europium, gadolinium, terbium, dysprosium, holmium, erbium, thulium, ytterbium and lutetium as $R_2O_3$ and 0.3 to 3 mole % of manganese oxide as MnO.

* * * * *